US005230290A

United States Patent [19]

Crossman

[11] Patent Number: 5,230,290

[45] Date of Patent: Jul. 27, 1993

[54] FLUSH-MOUNTED CRANK

[75] Inventor: Philip E. Crossman, Holland, Mich.

[73] Assignee: Leggett & Platt Incorporated, Carthage, Mo.

[21] Appl. No.: 895,771

[22] Filed: Jun. 9, 1992

[51] Int. Cl.[5] ..... A47B 9/00; G05G 1/10

[52] U.S. Cl. ..... 108/144; 108/147; 74/547; 74/557

[58] Field of Search ..... 74/545, 547, 555, 557, 74/89.15; 108/144, 147

[56] References Cited

U.S. PATENT DOCUMENTS

| | | | |
|---|---|---|---|
| 2,165,060 | 7/1939 | Krug | 74/547 |
| 2,721,106 | 10/1955 | Chaney | 108/147 |
| 2,808,303 | 10/1957 | Frank | 108/147 |
| 3,044,478 | 7/1962 | Russell | 74/547 X |
| 3,383,945 | 5/1968 | Carella | 74/547 |
| 3,967,511 | 7/1976 | Breitschwerdt | 74/547 X |
| 4,023,858 | 5/1977 | Beinert et al. | 74/545 X |
| 4,222,602 | 9/1980 | Kouth | 74/547 X |
| 4,487,558 | 12/1984 | Troutner | 74/547 X |
| 4,515,087 | 5/1985 | Kurrasch . | |
| 4,619,208 | 10/1986 | Kurrasch . | |
| 4,811,623 | 3/1989 | Tomiser, Jr. | 74/547 |
| 4,881,471 | 11/1989 | Schwartz et al. . | |
| 4,969,403 | 11/1990 | Schwartz et al. . | |
| 4,987,835 | 1/1991 | Schwartz et al. . | |
| 5,083,514 | 1/1992 | Schwartz et al. . | |

*Primary Examiner*—Richard M. Lorence

*Attorney, Agent, or Firm*—Varnum, Riddering, Schmidt & Howlett

[57] ABSTRACT

The invention is a crank which is flush-mounted into a work surface and provides for raising or lowering a vertically adjustable work surface. The crank can be raised from its stored position to a fixed position above the work surface and unfolded providing for rotating the crank to raise or lower the work surface by causing an adjustment screw to thread in or out of an adjustment nut. The crank is returned to its stored position or flush-mounted by folding the crank and pressing downward.

12 Claims, 6 Drawing Sheets

FLUSH-MOUNTED CRANK

BACKGROUND OF THE INVENTION

Field of the Invention

This invention relates to an apparatus for raising or lowering vertically adjustable work surfaces, and more specifically, to a flush-mounted crank for turning a screw mechanism which raises and lowers a vertically adjustable work surface.

Description of the Related Art

Mechanically adjustable work surfaces are used in a variety of working environments for adapting the work surface to the particular user, task, or situation. In office partition systems this adjustment is accomplished at installation by engaging hooks in slotted vertical rails at the appropriate height. The height of these can be changed by dismantling the surface and reinstalling it at a different height. Another common means of height adjustment involves telescoping fixed lower columns and adjustable upper members secured with clevis pins or bolts. These too, must be cleared of papers and equipment and are generally adjusted one end at a time by maintenance personnel with tools. Some surfaces, notably computer keyboard and monitor surfaces, are also equipped with some means to adjust the angle of the surfaces. For more frequent and convenient adjustment, work surfaces are generally equipped with some form of mechanical, electro-mechanical or hydraulic mechanism that can be controlled by the user without special tools and without removing things from the surface. Among these, most are operated by means of a motor or a manual crank, driving some form of screw, gear, or pump, via a shaft.

The problem with crank operated units has generally been the location of the crank. Many have placed cranks on some portion of the fixed base, but these are usually very inaccessible and often present a hazard to the user. In a few instances it is convenient to locate the crank below the surface at the front edge, but this often conflicts with the user's knees and is definitely incompatible on the rear half of a split-surface computer work station. Other solutions have simply provided a crank protruding through a hole in the top, but this clearly intrudes on the usable work space. Still others have made the crank removable to minimize the aforesaid problems, but these are frequently lost within the first few months of use.

SUMMARY OF THE INVENTION

The invention, advantageously, provides for a hand crank which is flush-mounted into the work surface providing for easy access and operation when the position of the work surface is changed. During the raising or lowering of the work surface, the crank according to the invention lies above the surface so as not to mar the surface during operation. After the work surface has obtained its desired position, the crank is repositioned within and below the work surface so as not to interfere with the available work area.

The invention also advantageously provides for locating a crank used to angularly adjust the work surface. The flush-mounted crank, according to the invention, can be used in combination with a worm-gear and a pair of cams attached to the bottom surface of the work surface, providing for easily and conveniently adjusting the angle of the work surface, especially in front and rear work surfaces of computer furniture.

According to the invention, a flush-mounted crank assembly comprises a crank, a hub and a trim housing. A pivot mounting pivotably mounts the crank to the hub for rotation about a horizontal axis between a stored position overlying the hub and an operative position along side the hub. A fitting is adapted to connect the hub to a shaft for rotation of the shaft about a vertical axis. The trim housing is shaped to receive the crank so that the crank can be stored within the trim housing when the crank is in the stored position. The hub is further slidably mounted in the trim housing for vertical movement of the hub and the crank with respect to the housing so that the crank can be raised out of the trim housing for operation of the crank. The hub is further mounted in the trim housing for rotation with respect to the trim housing about a vertical axis so that the crank, when raised out of the trim housing, can be rotated first about the horizontal axis and then rotated about a vertical axis to rotate the hub about the vertical axis.

Preferably, the trim housing has at least two resilient legs for releasably supporting the hub in a raised position for operation of the crank in the raised operative position. Further, the trim housing preferably comprises a ramp surface beneath an end of the crank proximate to the hub to raise the crank with respect to the hub by pressing on the crank end when the crank is in the stored position. In a preferred embodiment of the invention, the crank has a shaft which rotatably mounts a knob to facilitate rotation of the crank in the operative position about the vertical axis.

The crank assembly is preferably mounted in a vertical height adjustment mechanism between a work surface panel and a base for adjustably raising and lowering the work surface panel with respect to the base. In a preferred embodiment of the invention, the hub is nonrotatably connected to a threaded rod which is threaded in an adjustment nut mounted in the base so that the work surface panel is raised and lowered as the crank is rotated in the operative position. In this manner, the crank is directly connected to the drive mechanism without the need for gear reduction and double gears.

In a broader aspect of the invention, the hub can be coupled to the height mechanism through bevel gears, if desired.

BRIEF DESCRIPTION OF THE DRAWINGS

The invention will now be described with reference to the drawing in which.

DETAILED DESCRIPTION OF THE PREFERRED EMBODIMENTS

Figure 1:
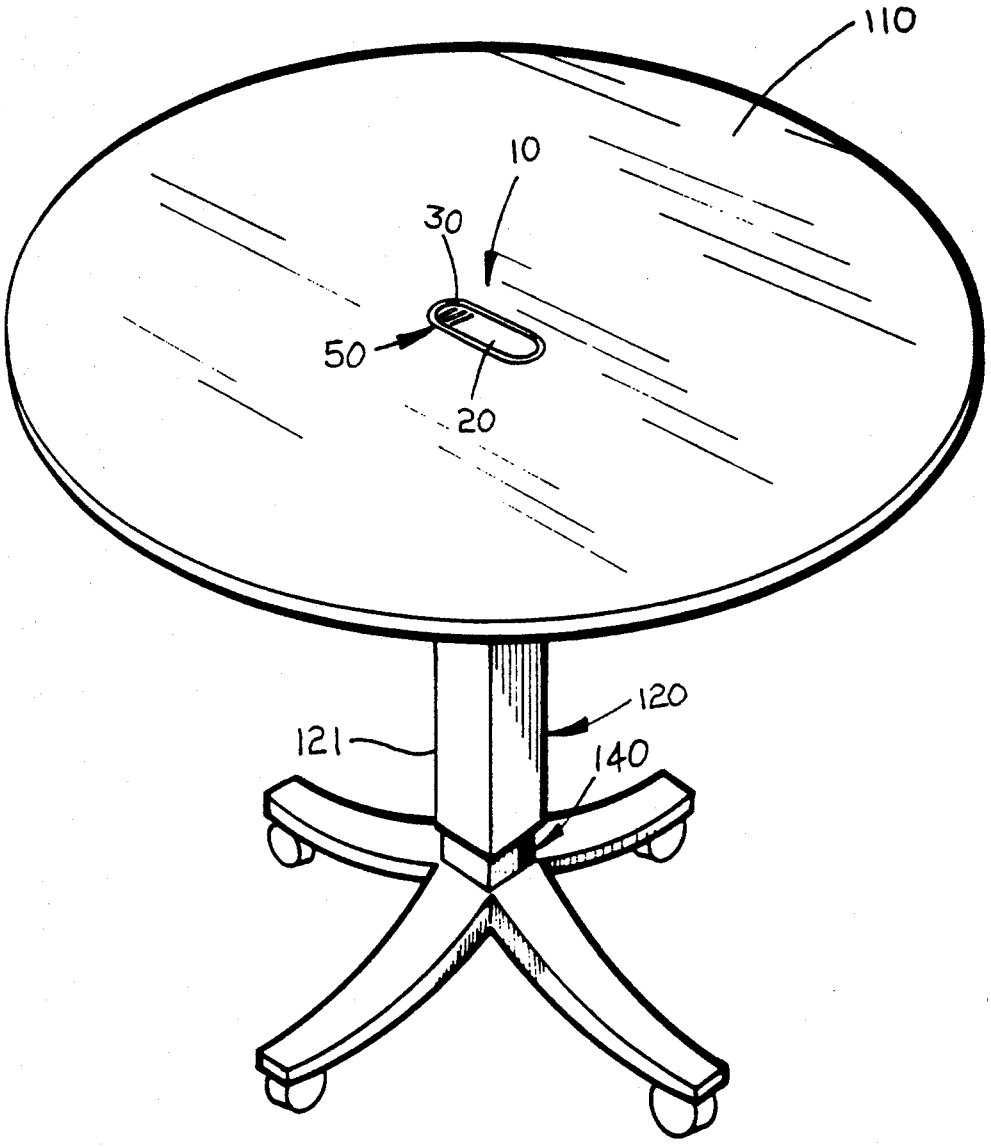
FIG 1 is a perspective view of the flush-mounted crank in a typical work surface and the crank is in the stored position.
Figure 2:
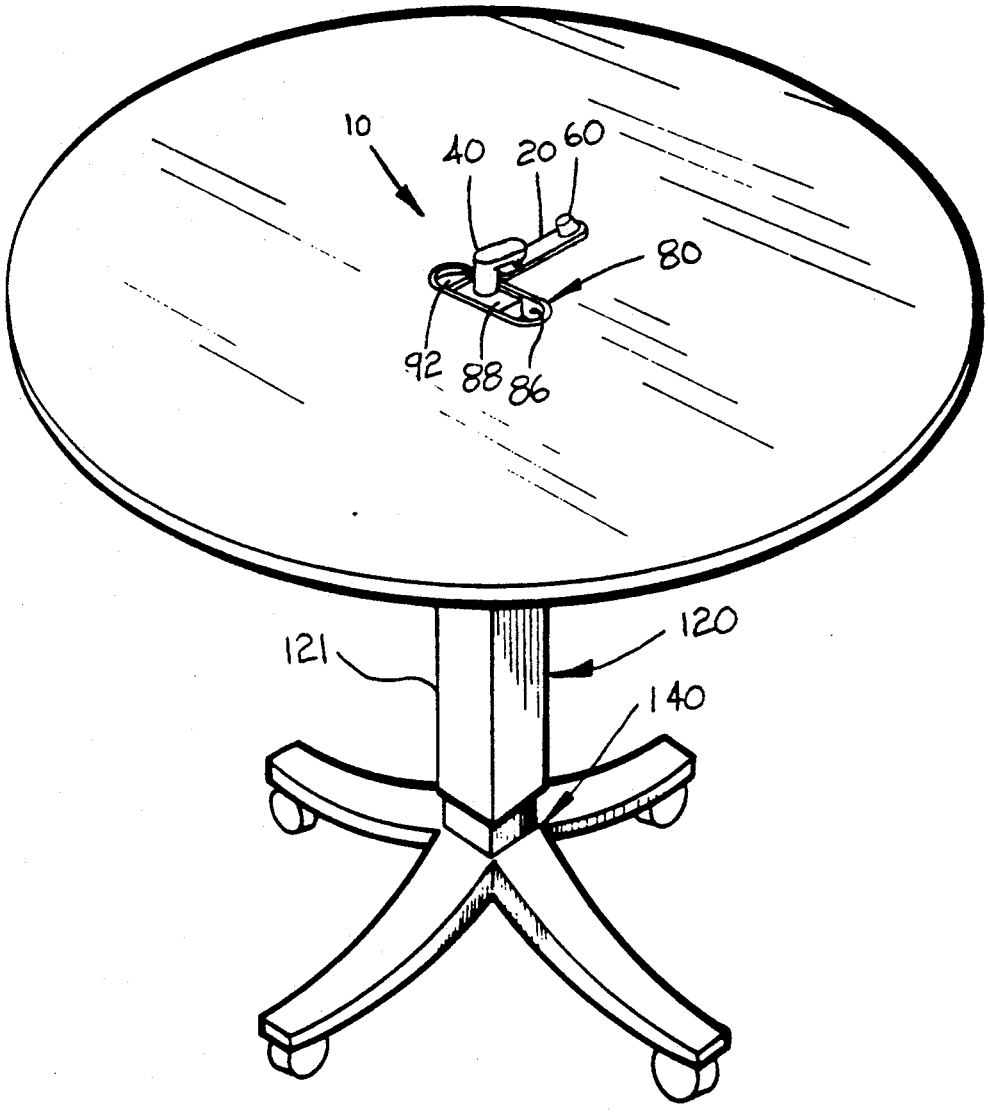
FIG. 2 is a perspective view of the flush-mounted crank mounted in a typical work surface and the crank is in the operable position.

FIGS. 1 and 2 illustrate the flush-mounted crank assembly 10 according to the invention. The flush-mounted crank assembly 10 comprises crank 20, hub 40, knob 60 and trim housing 80. The flush-mounted crank assembly 10 comprises a table surface mounted crank 20 which can be stored in the surface of the work surface or table top when the crank 20 is not in use. If the vertical position of the work surface needs to be raised or lowered, the crank 20 is easily popped up from its stored position and rotated to an operative position on the table surface so a user can rotate the crank to raise or lower the work surface to the desired position. FIG. 1 shows the crank 20 in the stored position and FIG. 2 shows the crank in the operative position.

Figure 3:
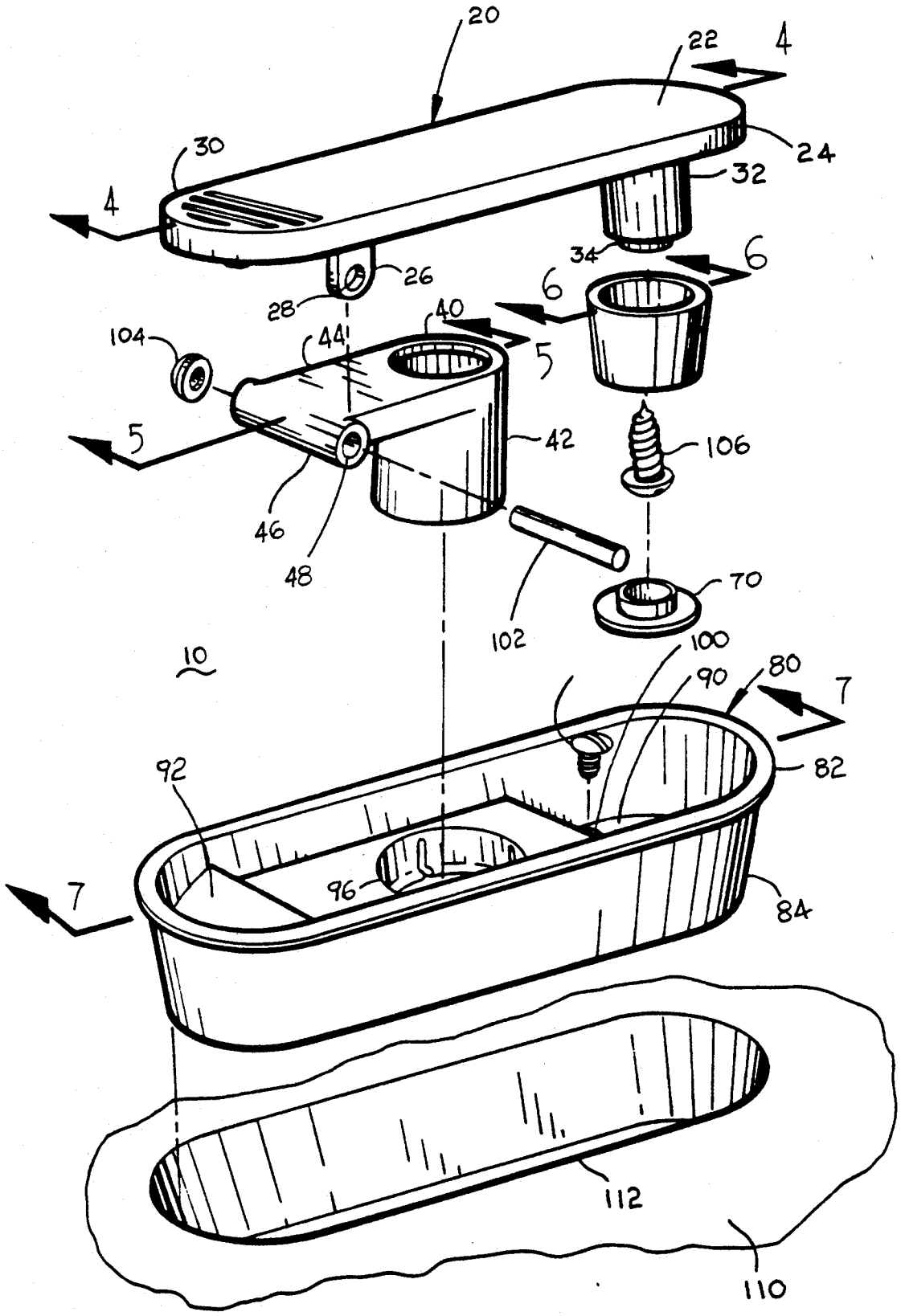
FIG. 3 is an exploded view of the flush-mounted crank according to the invention.
Figure 4:
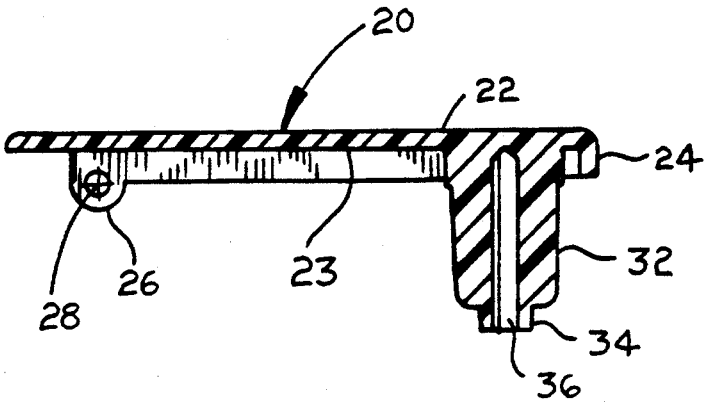
FIG. 4 is a sectional view along line 2—2 of FIG. 1.

Referring to FIGS. 3 and 4, the crank 20 can be of any desired shape. The crank 20 further comprises an upper surface 22 which is partially rimmed by a downwardly extending lip 24. The ends of the downwardly extending lip 24 terminate at opposed tabs 26 which have holes 28. A handle mounting post 32 is located near the end opposite the tabs 26 and extend downwardly from the lower surface 23 of the crank 20. The post 32 has a collar 34 extending downwardly and has a threaded hole 36 which extends upwardly into the post 32. Although the crank 20 can be formed from several independent pieces, it is preferred that the crank 20 be die cast, molded or machined as a single piece. The upper surface of the crank 20 can have indicia 30 on the end opposite the post 32 for indicating where pressure must be applied to urge the crank from its stored position. The crank 20 can be made from any suitable material, metal or plastic. A zinc die casting is preferred.

Figure 5:
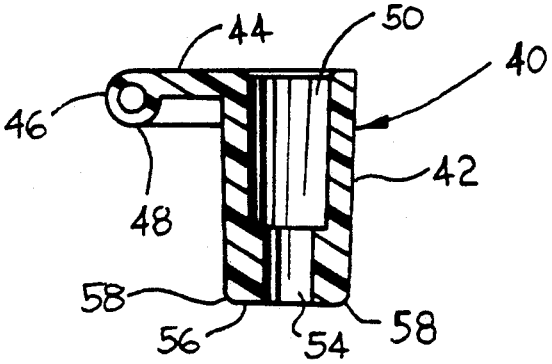
FIG. 5 is a sectional view along line 3—3 of FIG. 1.

Referring to FIGS. 3 and 5, the hub 40 comprises a tubular shaft 42 from which upper portion an arm 44 extends perpendicularly. The arm 44 terminates in a pivot 46 which has a pin hole 48. The tubular shaft 42 defines a hole 50 which terminates at a seat 52. An orifice 54 extends from the seat 52 to the bottom 56 of the tubular shaft 42. The shape of the orifice 54 is complementary to the shaft 130 of the adjustment screw 132, discussed below, and is preferably square-shaped, keyed or splined. The bottom 56 of the tubular shaft 42 has a beveled surface 58. The hub 40 is preferably made from metal, for example, a zinc die casting, but can be injection molded from a suitable plastic.

Figure 6:
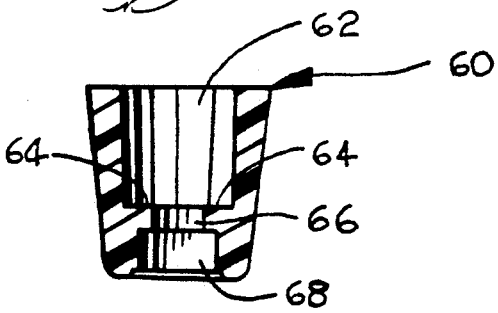
FIG. 6 is a sectional view along line 4—4 of FIG. 1.

Referring to FIGS. 3 and 6, the knob 60 is preferably shaped to provide a secure, comfortable grip while still permitting folding within the confines of the trim housing and is like an inverted, truncated cone and defines a post receiving hole 62 which terminates at a circular seat 64. The circular seat 64 has a collar receiving hole 66. A counter-sunk hole 68 terminates at the other side of the circular flange 64. The counter-sunk hole 68 is preferably shaped to receive snap cover 70. The knob 60 is preferably made from metal, but can be made of a suitable plastic.

Figure 7:
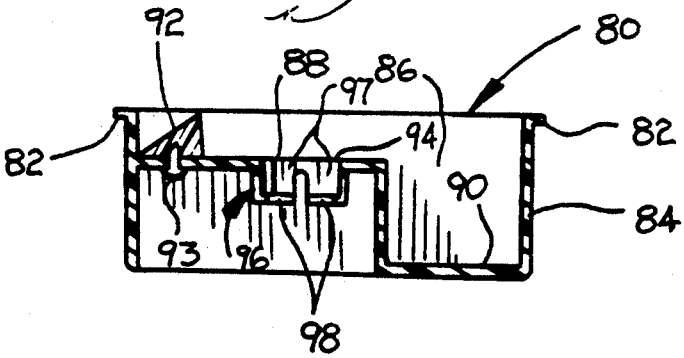
FIG. 7 is a sectional view along line 5—5 of FIG. 1.

Referring to FIGS. 3 and 7, the trim housing 80 comprises lip 82 extending radially outward from base 84. The shape of the trim housing 80 is preferably complementary to the shape of the crank 20. The lip 82 and the base 84 define a recessed or well area 86 whose bottom is formed by upper surface 88 and lower surface 90. A ramp 92 extends upwardly from the upper surface 88. The ramp 92 is shown as a separate piece from the upper surface in FIGS. 1 and 5 which is attached to the upper surface 88 by a screw 93. However, the ramp 92 can easily be formed with the trim housing 80 and does not necessarily need to be a separate piece.

The upper surface 88 has an opening 94 which forms the upper end of snap ring 96. The snap ring 96 comprises downwardly extending legs 97 which have inwardly extending flanges 98. Preferably, the snap ring 96 has four legs. The lower surface 90 has holes 100 and is preferably located a sufficient distance from the lip 82 that the knob 60 will fit between the lip 82 and lower surface 90 when the crank is in its stored position. Preferably, the trim housing 80 is molded as a single piece out of resilient material such as nylon, providing for the legs 97 of the snap ring 96 to flex radially without breaking.

Figure 8:
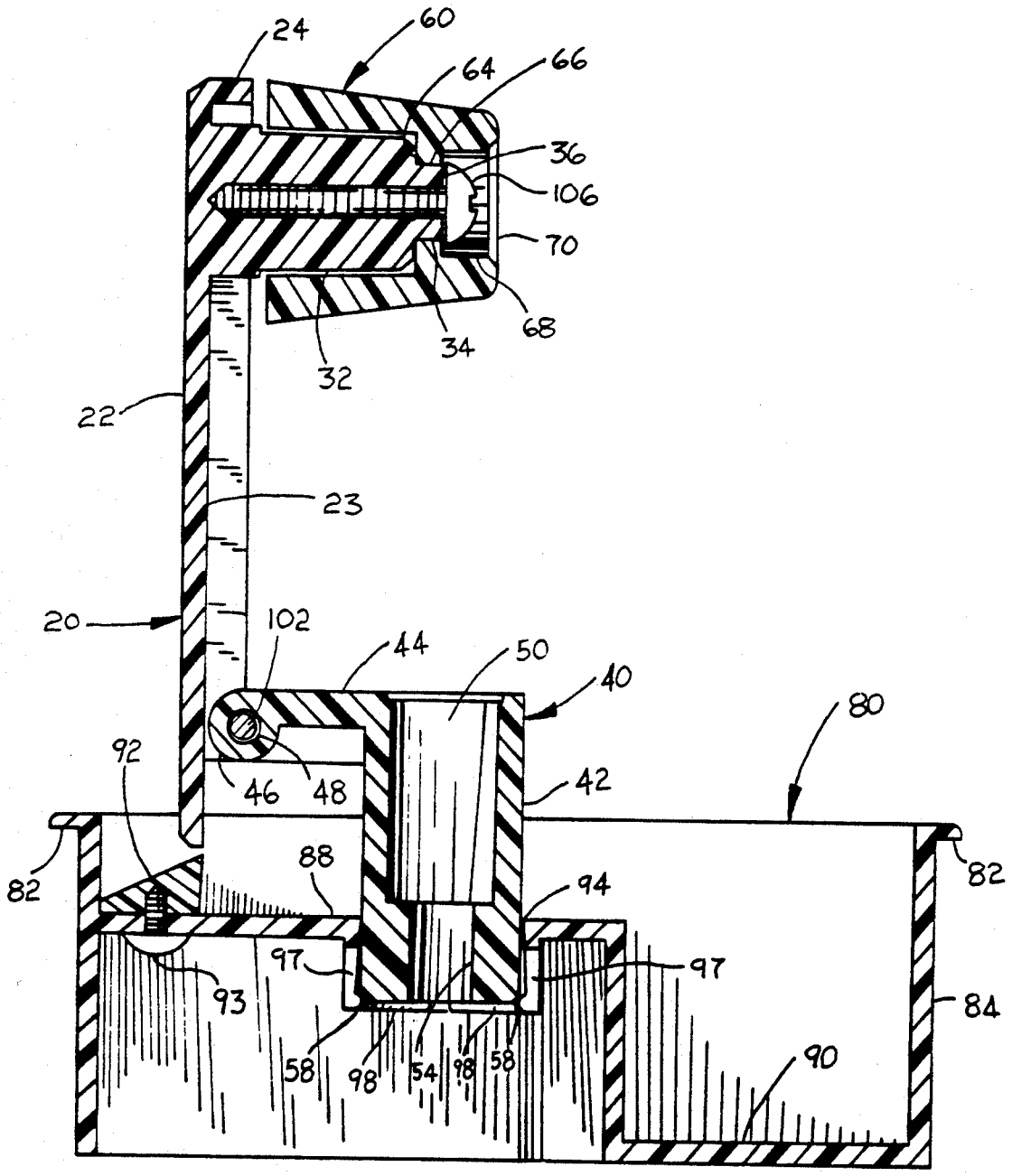
FIG. 8 is a sectional view of the assembled flush-mounted crank according to the invention in a first style of moving from stored to operative position.

FIG. 8 illustrates the flush-mounted crank. To assemble the flush-mounted crank assembly 10, the pivot 46 of the hub 40 is placed between the tabs 26 of the crank 20 so that the tab holes 28 and the pin holes 48 align. Pin 102 is inserted through the aligned holes 28, 48 and fixed in place by cap 104 (FIG. 3). By pinning the crank 20 to the hub 40, the crank 20 is free to pivot about the pin 102. The pin 102 and cap 104 could easily be replaced with a spring pin.

The knob 60 is attached to the crank 20 by inserting the post 32 and collar 34 into the post receiving hole 62 and collar receiving hole 66 of the knob 60, respectively, and threading screw 106 into threaded hole 36 until the head of the screw 106 contacts the circular flange 64 of the knob 60. Once the screw 106 is secured, the snap cover 70 is snapped into the counter-sunk hole 68. Preferably, the screw 106 is of a predetermined length so that the knob 60 is free to rotate about the post 32.

The crank 20 is connected to the trim housing 80 by inserting the tubular shaft 42 of the hub 40 into the opening 94 in the upper surface 88 of the trim housing 80, causing the beveled surface 58 of the shaft 42 of the hub 40 to force apart the legs 97 of the snap ring 96. The legs 97 of the snap ring 96 securely hold the hub 40 and crank 20 within the well 86 of the trim housing 80.

Figure 9:
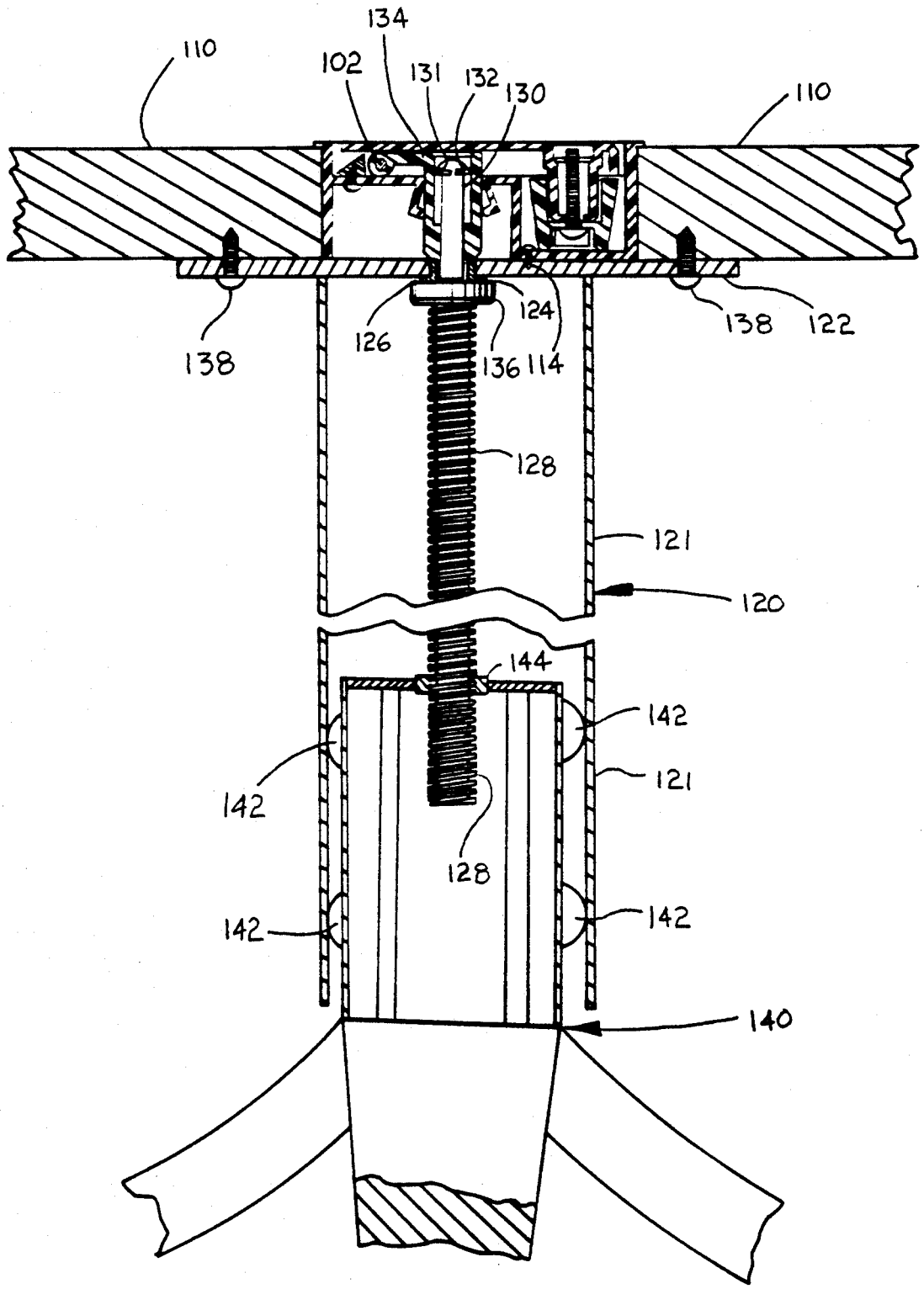
FIG. 9 is a partial sectional view illustrating the flush-mounted crank according to the invention connected to a typical vertically adjustable work surface in stored condition.

Referring to FIG. 9, the flush-mounted crank assembly 10 according to the invention is shown mounted in a typical height adjustable work surface having a single pedestal. The height adjustable work surface comprises work surface panel 110, adjustable pedestal 120 and base 140. The work surface panel 110 has bore 112 which is complementary in shape to the trim housing 80. Preferably, the bore 112 is of sufficient size that the base 84 of the trim housing 80 slidably mounts into the bore 112, but the lip 82 will rest upon the upper surface of the work surface panel 110. However, if desired, the bore 112 could include a counter bore which would provide for the lip 82 of the trim housing 80 to mount below or even with the upper surface of the work surface panel 110. The work surface panel 110 is shown as wood, but can be made of any suitable material.

The height adjustment mechanism or adjustable pedestal 120 comprises tube 121, mounting plate 122, shaft 130, and adjusting screw 128. The mounting plate 122 is fixedly connected to the tube 121. The mounting plate 122 has a central bore 124 which receives washer 126 through which the shaft 130 passes. The shaft 130 has threaded hole 131. The adjustment screw 128 is fixedly mounted to the shaft 130. The shaft 130 is complementary in shape to the orifice 54 of the hub 40.

The base 140 is complementary in shape to the pedestal 120 and comprises rollers 142 and adjustment nut 144. The base 140 is slidably mounted within the bottom of the tube 121 of the pedestal 120. The adjustment nut 144 is fixedly secured to the base 140.

The adjustable pedestal 120 is connected to the bottom of the work surface panel 110 by screws 138 which pass through holes in the mounting plate 122 and screw into the work surface panel 110. The base 140 is connected to the adjustable pedestal 120 by slidably inserting the base 140 into the interior of the tube 121 of the adjustable pedestal 120. The rollers 142 of the base 140 contact the sides of the adjustable pedestal 120 providing for the adjustable pedestal 120 to move vertically with respect to the base 140 without binding. The adjustment nut 144 is fixedly connected to the base 140 and the lower end of the adjusting screw 128 is threaded into the adjustment nut.

The flush-mounted crank assembly 10 is retained within the bore 112 of the work surface panel 110 by screws 114 which pass through the holes 100 in the lower surface 90 of the trim housing 80 and which thread into the mounting plate 122. The crank 20 is connected to the pedestal 120 by the shaft 130 which extends through a central bore 124 in the mounting plate 122 and through the orifice 54 in the hub 40. Preferably, a washer 134 is used in combination with the screw 132 to connect the hub 40 to the shaft 130, preventing the removal of the hub 40 from the shaft 130 after the screw 132 and washer 134 are mounted to the shaft 130. Preferably, the shaft 130 is of sufficient length to provide for the hub 40 to slide vertically with respect to the shaft 130 a sufficient distance for the beveled surface 58 of the hub to move vertically to a position above the flanges 98 of the snap ring 96, ensuring that the crank 20 will have sufficient room to rotate about the pin 102.

In operation, the operator presses downwardly on the indicia 30 located on the upper surface 22 of the crank 20, causing the crank 20 to rotate about the pivot 46, resulting in the end of the crank 20 to contact the surface of the ramp 92 and raising the knob 60 of the crank 20 above the work surface panel 110. The operator can then grasp the knob end of the crank 60 and causing the further rotation about pivot 46 of the crank 20 to remain in contact with the surface of the ramp 92 and forcing the shaft 42 of the hub 40 to move upwardly with respect to the legs 97 of the snap ring 96. Once the beveled surface 58 of the shaft 42 of the hub 40 moves above the flanges 98 of the snap ring 96, the sprung legs 97 of the snap ring 96 will move inwardly to their unsprung position, providing for the bevelled surface of the hub 40 to rest on the flanges 98 of the snap ring 96. In this position, the pivot 46 of the hub 40 is a sufficient height above the work surface panel 110 that the crank 20 can rotate about the pin 102 and is approximately parallel to the work surface panel 110. The upper surface 22 of the crank 20 thus faces the work surface panel 110 with the knob oriented upwardly. The operator can then rotate the crank 20 either clockwise or counterclockwise to adjust the height of the work surface panel 110 upwardly or downwardly, respectively. As the crank 20 is rotated, the adjustment screw 128 correspondingly rotates and moves vertically with respect to the fixed adjustment nut 144. As the adjustment screw 128 moves vertically with respect to the adjustment nut 144 the tube 121 of the adjustable pedestal 120 correspondingly moves vertically with respect to the base 140 and the rollers ensure that the pedestal 120 and base 140 does not bind. Once the work surface panel 110 is in the desired position, the crank 20 is rotated back to its stored position. The operator presses downwardly on the crank 20, causing the beveled surface to spring apart the legs 97 of the snap ring 96, providing for the lowering and storing of the crank 20 below the upper surface of the work surface panel 110.

Reasonable variation and modification are possible within the spirit of the foregoing specification and drawings without departing from the scope of the invention.

The embodiments for which an exclusive property or privilege is claimed are defined as follows:

1. A flush-mounted crank assembly comprising:

a crank;

a hub;

a pivot mounting for pivotably mounting the crank to the hub for rotation about a horizontal axis between a stored position overlying the hub and an operative position along side the hub;

a fitting for connecting the hub to a shaft for rotation of the shaft about a longitudinal axis;

a trim housing having at least two resilient legs for releasably supporting the hub in a raised position for rotation of the crank about the vertical axis in the operative position;

the trim housing being shaped to receive the crank so that the crank can be recess mounted in the trim housing;

the hub slidably mounted in the trim housing for vertical movement of the hub with respect to the housing so that the crank can be raised out of the trim housing; and the hub being further mounted in the trim housing for rotation with respect to the trim housing about the vertical axis;

whereby the crank when raised out of the trim housing can be rotated first about the horizontal axis and then rotated about the vertical axis to rotate the hub about the vertical axis.

2. A flush-mounted crank assembly according to claim 1 wherein the trim housing further comprises a ramp surface beneath one end of the crank proximate to the hub to raise the other end of the crank with respect to the hub by pressing down on the one end of the crank when the crank is in the stored position.

3. A flush-mounted crank assembly according to claim 2 wherein the crank has a shaft and further comprising a knob rotatably mounted to the crank.

4. A flush-mounted crank assembly according to claim 3 wherein the trim housing is shaped for accommodating the knob within the trim housing when the crank is in the stored position.

5. A flush-mounted crank assembly according to claim 4 wherein the trim housing is further shaped to provide clearance between the knob and the trim housing when the crank is raised from the stored position to the operative position.

6. A flush-mounted crank assembly according to claim 1 wherein the trim housing further comprises a ramp surface beneath one end of the crank proximate to the hub to raise the other end crank with respect to the hub by pressing down on the one end of the crank when the crank is in the stored position.

7. A height adjustable work surface assembly comprising a base, a work surface panel and a height adjustment mechanism for mounting the work surface to the base for vertical adjustment, and a flush-mounted crank assembly comprising:

a crank;

a hub;

a pivot mounting for pivotably mounting the crank to the hub for rotation about a horizontal axis between a stored position overlying the hub and an operative position along side the hub;

a fitting for connecting the hub to a shaft for rotation of the shaft about a longitudinal axis;

a trim housing which is flush-mounted in the work surface panel;

the trim housing being shaped to receive the crank so that the crank can be recess mounted in the trim housing;

the hub slidably mounted in the trim housing for vertical movement of the hub with respect to the housing so that the crank can be raised out of the trim housing; and the hub being further mounted in the trim housing for rotation with respect to the trim housing about a vertical axis;

whereby the crank when raised out of the trim housing can be rotated first about the horizontal axis and then rotated about the vertical axis to rotate the hub about the vertical axis.

8. A height adjustable work surface assembly comprising a base, a work surface panel and a height adjusted mechanism for mounting the work surface to the base for vertical adjustment, and flush-mounted crank assembly comprising:

a crank;

a hub;

a pivot mounting for pivotably mounting the crank to the hub for rotation about a horizontal axis between a stored position overlying the hub and an operative position along side the hub;

a fitting for connecting the hub to a shaft for rotation of the shaft about a longitudinal axis;

a trim housing, which is flush-mounted in the work surface panel;

the trim housing being shaped to receive the crank so that the crank can be recess mounted in the trim housing;

the hub slidably mounted in the trim housing for vertical movement of the hub with respect to the housing so that the crank can be raised out of the trim housing; and the hub being further mounted in the trim housing for rotation with respect to the trim housing about the vertical axis;

whereby the crank when raised out of the trim housing can be rotated first about the horizontal axis and then rotated about the vertical axis to rotate the hub about the vertical axis.

9. A height adjustment work surface assembly according to claim 7 wherein the base nonrotatably mounts an adjustment nut and a threaded rod which is threadably received in the adjustment nut, and the threaded rod is coupled to the hub fitting whereby the crank can drive the threaded rod for height adjustment of the work surface panel with respect to the base.

10. A height adjustable work surface assembly according to claim 7 wherein the trim housing further comprises a ramped surface beneath an end of the crank proximate to the hub to raise the crank with respect to the hub by pressing down on the crank end when the crank is in the stored position.

11. A height adjustable work surface assembly according to claim 7 wherein the trim housing has at least two resilient legs for releasably supporting the hub in a raised position for operation of the crank in the operative position.

12. A height adjustment work surface assembly according to claim 11 wherein the trim housing further comprises a ramped surface beneath one end of the crank proximate to the hub to raise the other end crank with respect to the hub by pressing down on the one end of the crank when the crank is in the stored position, then lifting the other end of the crank.

* * * * *

UNITED STATES PATENT AND TRADEMARK OFFICE

CERTIFICATE OF CORRECTION

PATENT NO. : 5,230,290

DATED : July 27, 1993

INVENTOR(S) : PHILLIP E. CROSSMAN

It is certified that error appears in the above-identified patent and that said Letters Patent is hereby corrected as shown below:

Column 6, line 26, "the" should be --a--.

Claim 8 should read as follows:

A height adjustment work surface assembly according to claim 7 wherein the base nonrotatably mounts an adjustment nut and a threaded rod which is threadably received in the adjustment nut, and the threaded rod is nonrotatably mounted to the hub fitting, whereby the crank directly drives the threaded rod for direct height adjustment of the work surface panel with respect to the base.

Signed and Sealed this

Twenty-ninth Day of March, 1994

*Attest:*

Bruce Lehman

BRUCE LEHMAN

*Attesting Officer*

*Commissioner of Patents and Trademarks*